US012043461B2

(12) United States Patent
Garnier

(10) Patent No.: US 12,043,461 B2
(45) Date of Patent: Jul. 23, 2024

(54) ARTICLE CARRIER AND BLANK THEREFOR

(71) Applicant: WestRock Packaging Systems, LLC, Atlanta, GA (US)

(72) Inventor: Jean-Michel Garnier, Issoudun (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/014,847

(22) PCT Filed: Nov. 4, 2021

(86) PCT No.: PCT/US2021/058008
§ 371 (c)(1),
(2) Date: Jan. 6, 2023

(87) PCT Pub. No.: WO2022/098838
PCT Pub. Date: May 12, 2022

(65) Prior Publication Data

US 2023/0286717 A1 Sep. 14, 2023

Related U.S. Application Data

(60) Provisional application No. 63/109,944, filed on Nov. 5, 2020.

(51) Int. Cl.
*B65D 71/42* (2006.01)

(52) U.S. Cl.
CPC ..... *B65D 71/42* (2013.01); *B65D 2571/0029* (2013.01); *B65D 2571/0066* (2013.01)

(58) Field of Classification Search
CPC ..... B65D 71/16; B65D 71/40; B65D 71/42; B65D 71/44; B65D 2571/0029; B65D 2571/0066

(Continued)

(56) References Cited

U.S. PATENT DOCUMENTS 3,493,261 A * 2/1970 Stout ..... B65D 71/16 294/87.2
4,304,329 A 12/1981 Graser
5,297,673 A * 3/1994 Sutherland ..... B65D 71/16 206/427

OTHER PUBLICATIONS

International Search Report issued in PCT/US2021/058008 dated Feb. 23, 2022.

* cited by examiner

*Primary Examiner* — Bryon P Gehman
(74) *Attorney, Agent, or Firm* — Brian J. Goldberg; Rohini K. Garg

(57) ABSTRACT

The disclosure relates to an article-engaging carrier for packaging one or more articles and a blank for forming the carrier. The carrier comprises a top panel (14) with at least one article-engaging feature (RT1, RT2). At least one shoulder panel (18, is hingedly connected to the top panel and is disposed obliquely with respect to the top panel. The at least one engaging feature comprises an article—receiving aperture (A1-A8) and an annular series of engaging tabs formed around the article-receiving aperture. The annular series of engaging tabs comprises at least one first tab (46B) and at least one second tab (46C). The at least one first tab is hingedly connected in part to the top panel and in part to the at least one shoulder panel. The at least one first tab has a first radial length (LT1). The at least one second tab is hingedly connected only to the top panel and has a second radial length (LT2). The first radial length is greater than the second radial length.

20 Claims, 5 Drawing Sheets

(58) Field of Classification Search
USPC ..... 206/147
See application file for complete search history.

ARTICLE CARRIER AND BLANK THEREFOR

CROSS REFERENCE TO RELATED APPLICATIONS

This Application is a U.S. 371 National Phase Patent Application of International PCT Patent Application No. PCT/US2021/058008, filed Nov. 4, 2021, which claims priority to U.S. Provisional Patent Application No. 63/109,944, filed on Nov. 5, 2020. The entire contents of these applications are incorporated herein by reference.

TECHNICAL FIELD

The present invention relates to article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article.

It is desirable that all the tabs efficiently or effectively engage the article. It is also desirable to provide impact a carrier with impact resistance to protect the articles.

The present invention seeks to provide an improvement in the field of cartons, typically formed from paperboard or the like.

SUMMARY

A first aspect of the invention provides an article carrier for packaging at least one article. The carrier comprises a top panel with at least one article-engaging feature and at least one shoulder panel hingedly connected to the top panel and disposed obliquely with respect to the top panel The at least one article-engaging feature comprises an article-receiving aperture and an annular series of engaging tabs formed around the article-receiving aperture. The annular series of engaging tabs comprises at least one first tab and at least one second tab. The at least one first tab is hingedly connected in part to the top panel and in part to the at least one shoulder panel. The at least one first tab has a first radial length. the at least one second tab is hingedly connected only to the top panel and has a second radial length. The first radial length is greater than the second radial length.

Optionally, the at least one first tab may be hingedly connected by a first fold line to the top panel and to the at least one shoulder panel. The first fold line may extend from the top panel into the at least one shoulder panel.

Optionally, the at least one shoulder panel may be hinged to the top panel by a shoulder panel fold line wherein the shoulder panel fold line is interrupted by the at least one first tab.

Optionally, the at least one first tab may be asymmetrical about a radially extending notional line passing through a midpoint of a first fold line by which the at least one first tab is hingedly connected to the top panel and the at least one shoulder panel.

Optionally, the annular series of engaging tabs may further comprise at least one third tab. The at least one first tab may be adjoined by the at least one third tab which is hingedly connected only to the at least one shoulder panel.

Optionally, the at least one third tab may have a third radial length which is greater than the second radial length.

Optionally, the at least one third tab may be formed in part from the at least one shoulder panel.

Optionally, the at least one first tab may comprise a pair of first tabs which are disposed with the at least one third tab therebetween.

A second aspect of the invention provides a blank for forming an article carrier. The carrier comprises a top panel with at least one article-engaging feature and at least one shoulder panel hingedly connected to the top panel and disposed obliquely with respect to the top panel when the blank is erected to form an article carrier. The at least one article-engaging feature comprises an article-receiving aperture and an annular series of engaging tabs formed around the article-receiving aperture. The annular series of engaging tabs comprises at least one first tab and at least one second tab. The at least one first tab is hingedly connected in part to the top panel and in part to the at least one shoulder panel. The at least one first tab has a first radial length. The at least one second tab is hingedly connected only to the top panel and has a second radial length. The first radial length is greater than the second radial length.

Optionally, the at least one first tab may have a maximum radial length and a minimum radial length wherein the first radial length may be the maximum radial length.

Optionally, the minimum radial length of the at least one first tab may be generally equal to the second radial length of the at least one second tab.

Optionally, the at least one first tab may have an opposed side edges, wherein the at least one first tab has the maximum radial length along one of the opposed side edges.

Optionally, the at least one first tab may have the minimum radial length along the other of the opposed side edges.

Optionally, the at least one first tab may have a radial size which decreases gradually from one of the opposed side edges toward the other of the opposed side edges.

Optionally, the at least one first tab may have an opposed side edges wherein the at least one first tab may have the minimum radial length along one of the opposed side edges.

Optionally, the one of the opposed side edges of the at least one first tab may be adjoined by the at least one second tab.

Optionally, the annular series of engaging tabs may further comprise at least one third tab wherein the at least one first tab may be adjoined by the at least one third tab which is hingedly connected only to the at least one shoulder panel.

Optionally, the at least one third tab may have a third radial length which is greater than the second radial length.

Optionally, the at least one third tab may be formed in part from the at least one shoulder panel.

Optionally, the at least one first tab may comprise a pair of first tabs which are disposed with the at least one third tab therebetween.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
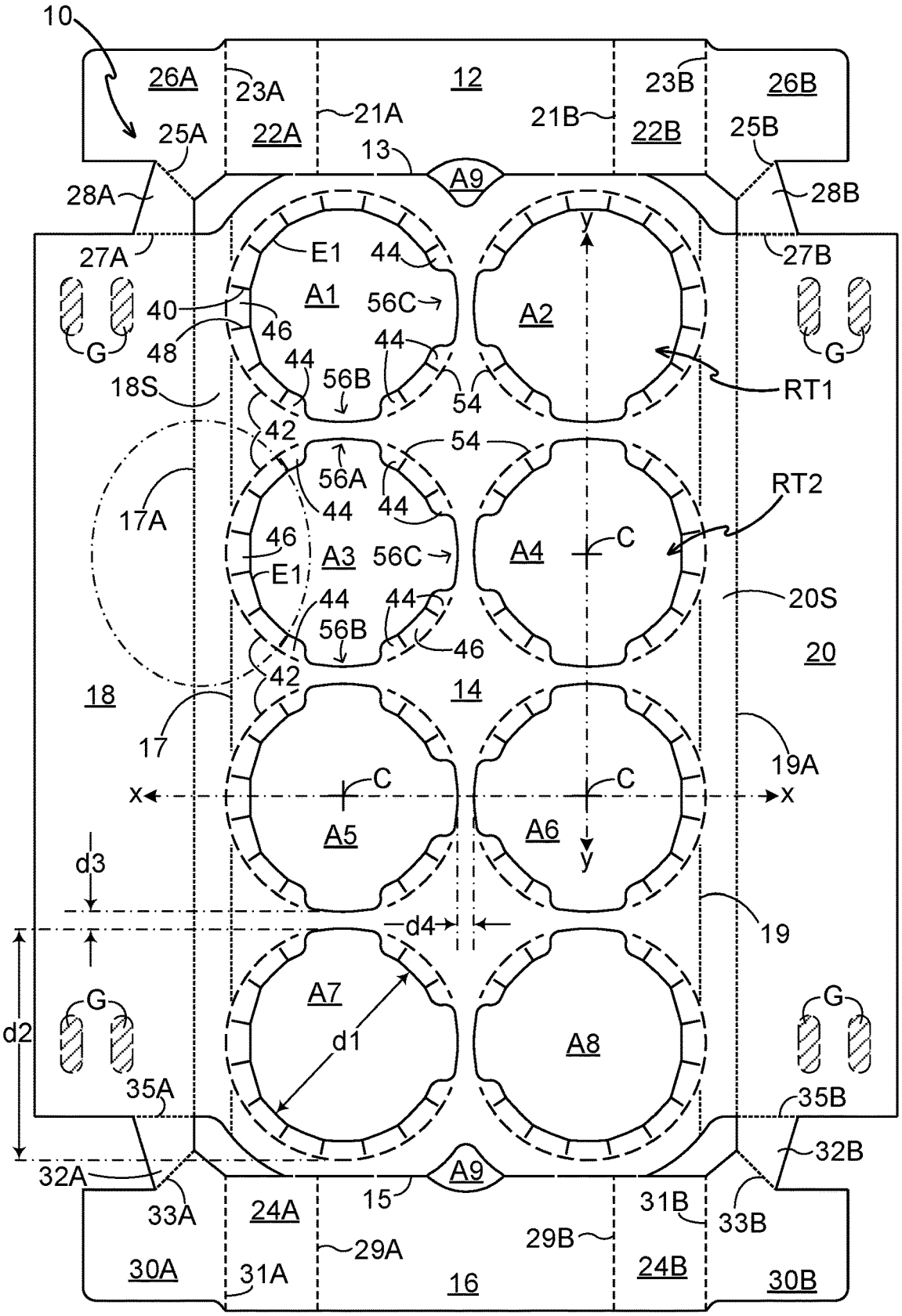
FIG. 1 is a plan view from above of a blank for forming a carrier according to a first embodiment.
Figure 2:
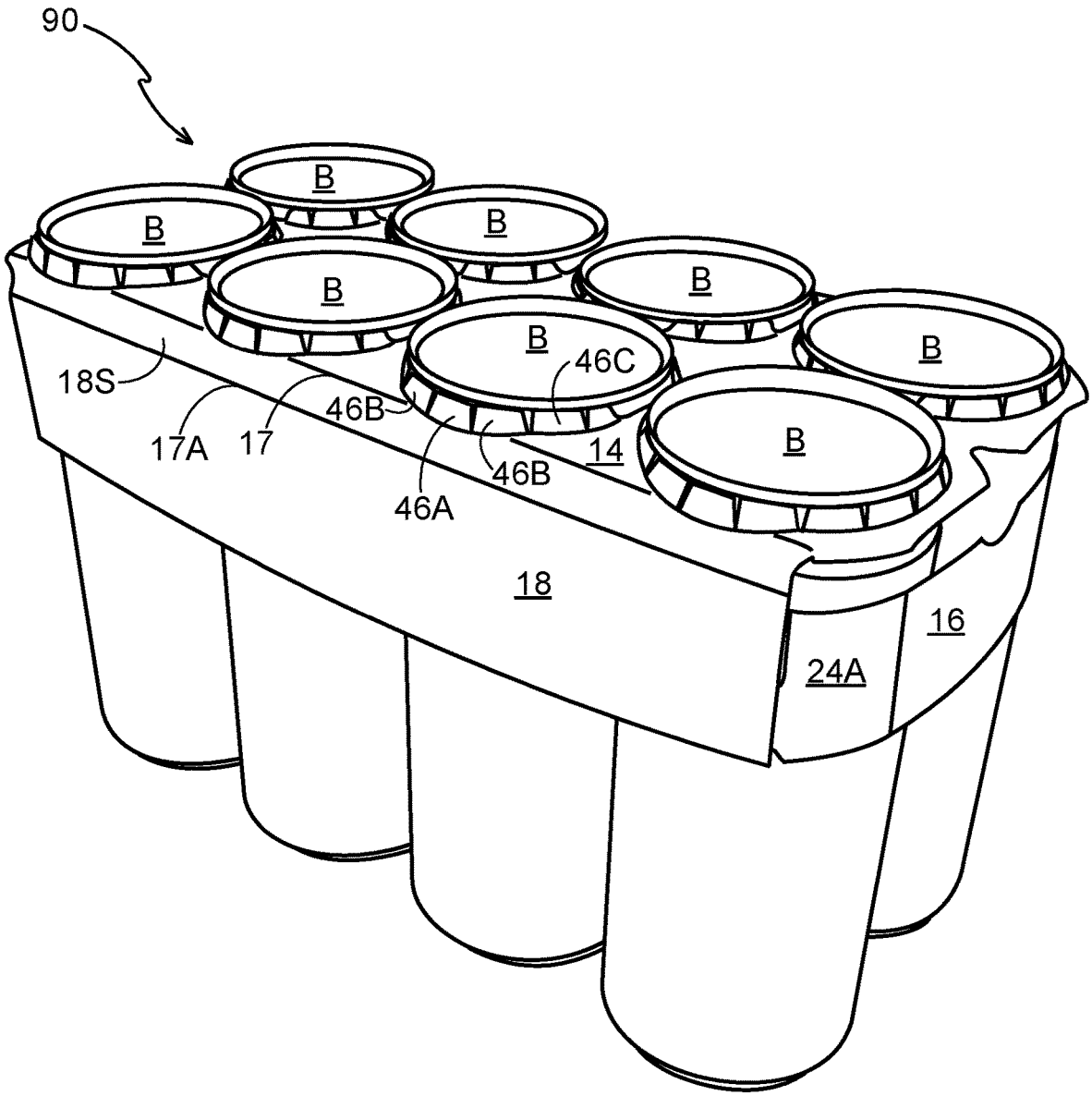
FIG. 2 is a perspective view from above of a carrier formed from the blank of FIG. 1.
Figure 3B:
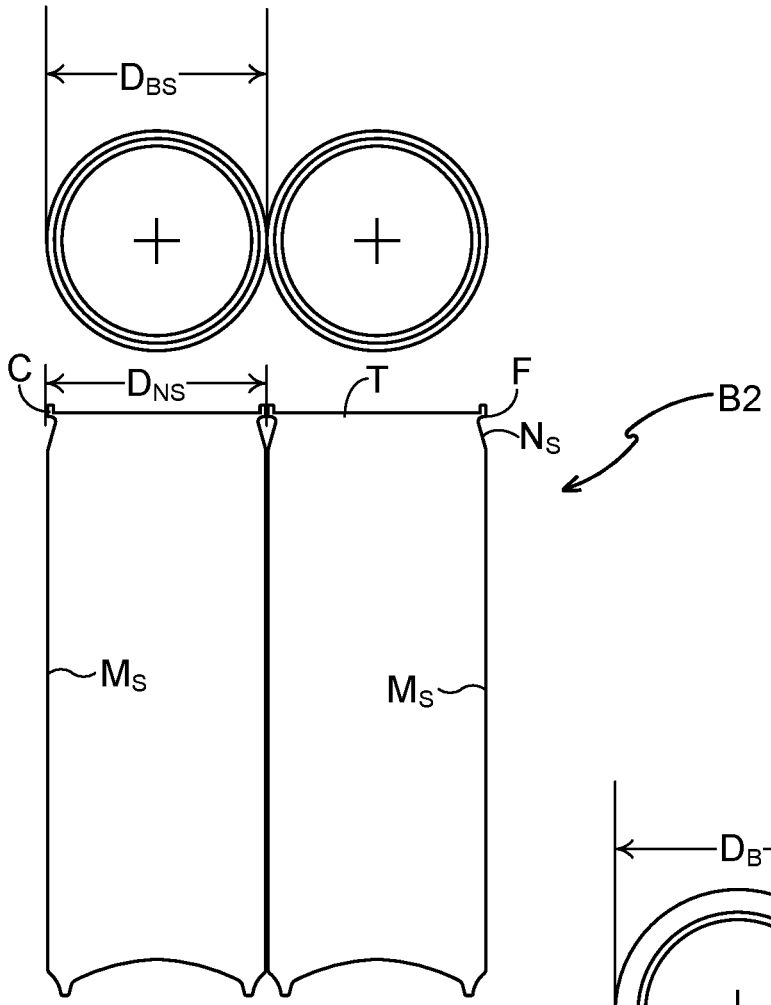
FIG. 3B is a plan view and side view of a pair of second articles.
Figure 3A:
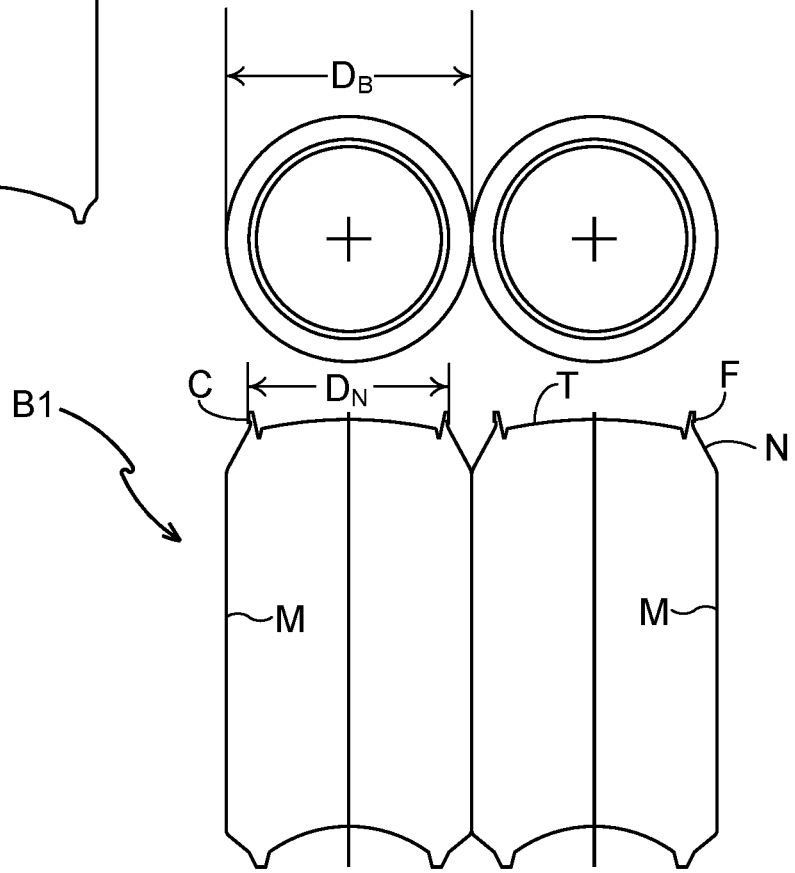
FIG. 3A is a plan view and side view of a pair of first articles for use with the blank of FIG. 1.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 2. The blank 10 forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blank 10 is configured to form a carton or carrier 90 for packaging an exemplary arrangement of exemplary articles B, examples of which shown are shown in FIGS. 7A and 7B which illustrate first and second articles B1, B2 respectively. In the illustrated embodiment the arrangement is a 2×4 matrix or array—two rows of four articles B are provided—and the articles B are beverage cans. Alternatively, the blank 10 can be configured to form a carrier for packaging other types, number and size of articles and/or for packaging articles in a different arrangement or configuration.

The illustrated embodiment is configured to accommodate beverage cans of the sleek or slim design that may be 330 ml cans. The articles B are substantially of the same diameter over their entire height. An exemplary article B2 is illustrated in FIG. 7B, the article B2 has a maximum diameter or lateral dimension $D_{BS}$ (the diameter $D_{BS}$ may be about 2.25 inches or about 58 mm). The article B2 comprises an upper portion or top closure T which has a diameter or lateral dimension $D_{Ns}$ (the diameter $D_{Ns}$ may be about 2.125 inches or 54.8 mm).

The neck $N_S$ may provide an outwardly projecting flange, that is to say it may comprise an undercut for engaging with the carrier. A top closure T may be attached to the side wall of the article B2 to form a seam or "chime" C which provides the flange F. In some embodiments the variation in diameter between the top closure and the main body $M_S$ of the article B2 is less than 7 mm, may be less than 5 mm and optionally is less than 4 mm.

As used herein the terms "sleek" or "slim" refer to articles B2 which have little or no variation in their lateral dimension between the top closure T which engages with the carrier 90 and the main body $M_S$ of the article B2. The articles B2 are substantially parallel sided or of substantially uniform diameter.

In other embodiments, the beverage cans may be of a different size for example, but not limited to, 350 ml beverage cans. An exemplary article B1 is illustrated in FIG. 7A, the article B1 has a maximum diameter or lateral dimension $D_B$ (the diameter $D_B$ may be about 2.6 inches or about 66 mm). The article B1 comprises an upper portion or top closure which has a diameter or lateral dimension $D_N$ (the diameter $D_N$ may be about 2.125 inches or 54.8 mm). In some embodiments the variation in diameter between the top closure and the main body M of the article B1 is greater than 7 mm, may be 10 mm or more and optionally may be at least 12 mm.

Referring to FIG. 1 there is shown a blank 10 comprising a plurality of panels 12, 14, 16, 18, 20, including a main panel 14 for forming a top wall or an engaging panel of a carrier 90 (see FIG. 2).

The blank 10 includes a first side panel 18 hingedly connected to a first side of the main panel 14 by a hinged connection in the form of a fold line 17; more specifically, the main panel 14 is hingedly connected to a first outer shoulder panel 18S forming part of the first side panel 18. The blank 10 includes a second side panel 20 hingedly connected to a second side of the main panel 14 by a hinged connection in the form of a fold line 19; more specifically, the main panel 114 is hingedly connected to a second outer shoulder panel 20S forming part of the second side panel 20.

The first outer shoulder panel 18S is hinged to the first side panel 18 by a hinged connection in the form of a fold line 17A. The second outer shoulder panel 20S is hinged to the second side panel 20 by a hinged connection in the form of a fold line 19A.

The blank 10 comprises a first end strap 26A/22A/12/22B/26B and a second end strap 30A/24A/-16/24B/30B.

The first end strap 26A/22A/12/22B/26B comprises a first end panel 12. A first corner panel 22A is hingedly connected to a first end of the first end panel 12 by a hinged connection in the form of a fold line 21A. A first securing panel 26A is hingedly connected to an end of the first corner panel 22A by a hinged connection in the form of a fold line 23A. A first gusset panel 28A is hingedly interconnected between the first securing panel 26A and a first end of the first side panel 18 by fold lines 25A, 27A.

A second corner panel 22B is hingedly connected to a second end of the first end panel 12 by a hinged connection in the form of a fold line 21B. A second securing panel 26B is hingedly connected to an end of the second corner panel 22B by a hinged connection in the form of a fold line 23B. A second gusset panel 28B is hingedly interconnected between the second securing panel 26B and a first end of the second side panel 20 by fold lines 25B, 27B.

The first end strap 26A/22A/12/22B/26B is partially separated from, or severable from, the main panel 14. The first end panel 12 is partially separated from, or severable from, the main panel 14. The blank 10 may comprise at least two cut lines, or frangible lines for severing, separating the first end panel 12 from the main panel 14. The cutlines may be interrupted by an aperture A9 struck in part from the first end panel 12 and in part from the main panel 14.

The first corner panel 22A is separated from the main panel 14. The blank 10 may comprise an aperture separating, at least in part, the first corner panel 22A from the main panel 14. The first corner panel 22A may be separated, at least in part, from the main panel 14 by a cut line or frangible line. The aperture defines a filleted, rounded or mitred corner of the main panel 14.

The second corner panel 22B is separated from the main panel 14. The blank 10 comprises an aperture separating, at least in part, the second corner panel 22B from the main panel 14. The second corner panel 22B may be separated, at least in part, from the main panel 14 by a cut line or frangible line. The aperture defines a filleted, rounded or mitred second corner of the main panel 14.

The first end strap 26A/22A/12/22B/26B forms a first end wall of the carrier 90.

The second end strap 30A/24A/16/24B/30B comprises a second end panel 16. A third corner panel 24A is hingedly connected to a first end of the second end panel 16 by a hinged connection in the form of a fold line 29A. A third securing panel 30A is hingedly connected to an end of the third corner panel 24A by a hinged connection in the form of a fold line 31A. A third gusset panel 32A is hingedly interconnected between the third securing panel 30A and a second end of the first side panel 18 by fold lines 33A, 35A.

A fourth corner panel 24B is hingedly connected to a second end of the second end panel 16 by a hinged connection in the form of a fold line 29B. A fourth securing panel 30B is hingedly connected to an end of the fourth corner panel 24B by a hinged connection in the form of a fold line 31B. A fourth gusset panel 32B is hingedly interconnected between the fourth securing panel 30B and a second end of the second side panel 20 by fold lines 33B, 35B.

The second end strap 30A/24A/16/24B/30B is partially separated from, or severable from, the main panel 14. The second end panel 16 is partially separated from, or severable from, the main panel 14. The blank 10 may comprise at least two cut lines, or frangible lines severing, separating the second end panel 16 from the main panel 14. The cutlines may be interrupted by an aperture A9 struck in part from the first end panel 12 and in part from the main panel 14.

The third corner panel 24A is separated from the main panel 14. The blank 10 comprises an aperture separating, at least in part, the third corner panel 24A from the main panel 14. The third corner panel 24A may be separated, at least in part, from the main panel 14 by a cut line or frangible line. The aperture defines a filleted, rounded or mitred third corner of the main panel 14.

The fourth corner panel 24B is separated from the main panel 14. The blank 10 comprises an aperture separating, at least in part, the fourth corner panel 24B from the main panel 12. The fourth corner panel 24B may be separated, at least in part, from the main panel 14 by a cut line or frangible line. The aperture defines a filleted, rounded or mitred fourth corner of the main panel 14.

The second end strap 30A/24A/16/24B/30B forms a second end wall of the carrier 90.

The main panel 14 may include at least one article retention structure RT1, RT2. In the illustrated embodiment, the main panel 14 comprises a plurality of article retention structures RT1, RT2 specifically eight article retention structures RT1, RT2 arranged in 4×2 matrix or array. The main panel 14 comprises two columns of article retention structures RT1, RT2, each column comprises four article retention structures RT1, RT2. The main panel 14 comprises four rows of article retention structures RT1, RT2, each row comprises two article retention structures RT1, RT2. Each of the article retention structures RT1, RT2 may comprise an aperture A1, A2, A3, A4, A5, A6, A7, A8.

The blank 10 comprises four first article retention structures RT1. The first article retention structures RT1 are located adjacent to ends of the main panel 14. The blank 10 comprises four second article retention structures RT2. The second article retention structures RT2 are located between a first pair of first article retention structures RT1 disposed proximate a first end of the main panel 14 and a second pair of first article retention structures RT1 disposed proximate a second end of the main panel 14. The second article retention structures RT2 are also referred to herein as intermediate article retention structures RT2. The first article retention structures RT1 are also referred to herein as end article retention structures RT1.

Article retention structures RT1, RT2 in the same column are spaced apart from each other by a spacing d3. Adjacent article retention structures RT1, RT2 are disposed in close proximity to each other.

Article retention structures RT1, RT2 in the same row are spaced apart from each other by a spacing d4. Adjacent article retention structures RT1, RT2 are disposed in close proximity to each other.

Each of the first article retention structures RT1 is substantially similar in construction and will therefore be described in detail with reference to a first one of the first article retention structures RT1 located adjacent to a first end of the blank 10 as shown in FIG. 1.

The first article retention structure RT1 comprises an article receiving opening defined in part by an aperture A1.

The first article retention structure RT1 comprises a plurality of teeth 46, 44 disposed about the aperture A1. The plurality of teeth 46, 44, or at least free edges thereof, may define or approximate a notional circle. The notional circle has a diameter d1.

The apertures A1, A2, A7, A8 have a width dimension d1. The article receiving openings has width or diameter d2. The diameter d2 of the article receiving openings is greater than the diameter d1 of notional circle or apertures A1, A2, A7, A8.

The plurality of teeth 46, 44 are hinged to the main panel 14 by a fold line. The fold line may be defined by a plurality of cut lines 42, 54. The plurality of cut lines 42, 154 may define or approximate a circle.

The first article retention structure RT1 comprises a plurality of first or full teeth 146 disposed about the aperture A1. Each of the plurality of first teeth 46 comprises an engaging edge E1 opposing a hinged edge. The engaging edges E1 are defined by a linear portion of a cut line defining the aperture A1. Each engaging edge E1 defines a part of a hexadecagon. The illustrated embodiment comprises thirteen first teeth 46 together defining a substantial portion of a hexadecagon. Each tooth 46 comprises a pair of side edges, the side edges are defined by cut lines 48, 40 extending radially outward from respective vertices of the hexadecagon. That is to say from a respective vertex between a pair of adjacent linear portions of the cut line defining the aperture A1. The cut lines 48, 40 are divergently arranged with respect to each other and define an angle therebetween, the angle may be about 22.5°.

The first article retention structure RT1 comprises a plurality of first circumferential cut lines 54. Each of the plurality of first circumferential cut lines 54 is aligned with one of the radial cut lines 48, 40 such that said one of the radial cut lines 48, 40 or a notional extension thereof bisects a respective one of the plurality of first circumferential cut lines 54.

Each of the plurality of first circumferential cut lines 54 is spaced apart from said one of the radial cut lines 48, 40 bisecting it so as to define a connecting nick or bridge portion between a pair of adjacently disposed teeth 46, 44.

Each of the plurality of first circumferential cut lines 54 may be linear in shape.

The first article retention structure RT1 comprises a plurality of second circumferential cut lines 42. Each of the plurality of second circumferential cut lines 42 is disposed between a pair of the plurality of first circumferential cut lines 54 and is spaced apart therefrom so as to define a pair of connecting nick or bridge portions between each tooth 46, 44 and the main panel 14. The pair of connecting nick or bridge portions provide a hinged or foldable connection between each tooth 46, 44 and the main panel 14.

Each of the plurality of second circumferential cut lines 42 may be linear in shape.

In alternative embodiments each of the plurality of first circumferential cut lines 54 may be arcuate or curved. The first circumferential cut lines 54 may comprise a radius of curvature which is equal to half the diameter d2 of the article receiving openings. The first circumferential cut lines 54 may comprise a radius of curvature which is greater than half the diameter d1 of the apertures A1, A2, A7, A8.

In alternative embodiments, each of the plurality of second circumferential cut lines 42 may be arcuate or curved. The second circumferential cut lines 42 may comprise a radius of curvature which is equal to half the diameter d2 of the article receiving openings. The second circumferential cut lines 42 may comprise a radius of curvature which is greater than half the diameter d1 of the aperture A1, A2, A7, A8.

The first and second circumferential cut lines 42, 54 when linear may be considered to define portions of a circle of infinite radius.

In the illustrated embodiment, the radius of curvature of each of the plurality of second circumferential cut lines 42 is equal to the radius of curvature of each of the plurality of first circumferential cut lines 54 however in other embodiments it may be different.

Optionally, the plurality of teeth 46, 44 is interrupted by a first recess or cutaway 56B. The first recess 56B lies upon a first notional line y-y. First notional line y-y extends radially from the centre C of the apertures A1, A2, A7, A8 and passes through the centre of the first recess 56B. The first notional line y-y may extend across the grain of the blank 10. The first notional line y-y is oriented perpendicularly with respect to the grain direction. The first notional line y-y extends longitudinally of the blank 10.

Optionally, the plurality of teeth 46, 44 is interrupted by a second recess or cutaway 56C. The second recess 56C lies upon a second notional line x-x. Second notional line x-x extends radially from the centre C of the apertures A1, A2, A7, A8 and passes through the centre of the second recess 56C. The second notional line x-x may extend along the grain of the blank 10. The notional line x-x is oriented parallel with respect to the grain direction. The notional line x-x extends transversely, or laterally, of the blank 10.

The first recess 56B is dimensioned so as to occupy a first arc defined by a first minor sector. The first minor sector is defined in part by a first sector notional line extending radially from the centre C of the notional circle and passing through a side edge of a first partial tooth 44 disposed adjacent a first side of the first recess 56B and in part by a second sector notional line extending radially from the centre C of the notional circle and passing through a side edge of a second partial tooth 44 disposed adjacent a second, opposing, side of the first recess 56B. The first and second sector notional lines define a second angle therebetween. The second angle may be in the range 35° to 50°, and may be around 45°.

The second recess 56C is dimensioned so as to occupy a second arc defined by a second minor sector. The second minor sector is defined in part by a third sector notional line extending radially from the centre C of the notional circle and passing through a side edge of a third partial tooth 44 disposed adjacent a first side of the second recess 56B and in part by a fourth sector notional line extending radially from the centre C of the notional circle and passing through a side edge of a fourth partial tooth 44 disposed adjacent a second, opposing, side of the second recess 56B. The third and fourth sector notional lines define a third angle therebetween. The third angle may be in the range 35° to 50°, and may be around 45°.

The first and third sector notional lines define a major or first toothed sector, the first toothed sector defines a third arc; the third arc is occupied by teeth 46, 44. That is to say teeth 46, 44 are disposed about the third arc, in a perimeter region of the first aperture A1.

The second and fourth sector notional lines define a third minor sector or second toothed sector, the second toothed sector defines a fourth arc; the fourth arc is occupied by teeth 46, 44. That is to say teeth 46, 44 are disposed about the fourth arc, in a perimeter region of the first aperture A1.

Each of the second article retention structures RT2 is substantially similar in construction and will therefore be described in detail with reference to a first one of the second article retention structures RT2 located adjacent to the first one of the first article retention structures RT1 as shown in FIG. 1.

The second article retention structure RT2 comprises an article receiving opening defined in part by a second aperture A3, A4, A5, A6.

The second article retention structure RT2 comprises a plurality of teeth 46, 44 disposed about the second aperture A3. The plurality of teeth 46, 44, or at least free edges thereof, may define or approximate a second notional circle.

The plurality of teeth 46, 44 are hinged to the main panel 14 by a fold line. The fold line may be defined by a plurality of cut lines 42, 54. The plurality of cut lines 42, 54 may define or approximate a circle.

The second aperture A3 comprises a plurality of first or full teeth 46 disposed about the second aperture A3. Each of the plurality of first teeth 46 comprises an engaging edge E1 opposing a hinged edge. The engaging edges E1 are defined by a linear portion of a cut line defining the second aperture A3. Each engaging edge E1 defines a part or side of a hexadecagon. The illustrated embodiment comprises ten first teeth 46 together defining a substantial portion of a hexadecagon. Each tooth 46 comprises a pair of side edges, the side edges are defined by cut lines 48, 40 extending radially outward from respective vertices of the hexadecagon. That is to say from a respective vertex between a pair of adjacent linear portions of the cut line defining the second aperture A3. The cut lines 48, 40 are divergently arranged with respect to each other and define an angle therebetween, the angle may be about 22.5°.

The second article retention structure RT2 comprises a plurality of first circumferential cut lines 54. Each of the plurality of first circumferential cut lines 54 is aligned with one of the radial cut lines 48, 40 such that said one of the radial cut lines 48, 40, or a notional extension thereof, bisects a respective one of the plurality of first circumferential cut lines 54.

Each of the plurality of first circumferential cut lines 54 is spaced apart from said one of the radial cut lines 48, 40 bisecting it so as to define a connecting nick or bridge portion between a pair of adjacently disposed teeth 46, 44. The connecting nick or bridge portion is disposed proximate a base of the teeth 46.

Each of the plurality of first circumferential cut lines 54 may be linear in shape.

The second article retention structure RT2 comprises a plurality of second circumferential cut lines 42. Each of the plurality of second circumferential cut lines 42 is disposed between a pair of 30 the plurality of first circumferential cut lines 54 and is spaced apart therefrom so as to define a pair of connecting nick or bridge portions between each tooth 46, 44 and the main panel 14. The pair of connecting nick or bridge portions provide a hinged or foldable connection between each tooth 46, 44 and the main panel 14.

Each of the plurality of second circumferential cut lines 42 may be linear in shape.

The plurality of teeth 46, 44 is interrupted by a first recess or cutaway 56B, by a second recess or cutaway 56C and by a third recess or cutaway 56A. The first and third recesses 56B, 56A each lie upon the first notional line y-y. The first notional line y-y extends radially from the centre C of the second aperture A3 and passes through the centre of each of the first and third recesses 56B, 56A.

The first recess 56B is dimensioned so as to occupy a first arc defined by a first minor sector. The first minor sector is defined in part by a first sector notional line extending radially from the centre C of the notional circle and passing through a side edge of a first partial tooth 44, disposed adjacent to a first side of the first recess 56B, and in part by a second sector notional line extending radially from the centre of the notional circle and passing through a side edge of a second partial tooth 44, disposed adjacent to a second, opposing, side of the first recess 56B. The first and second sector notional lines define an angle therebetween. The angle may be in the range 35° to 50°, and may be around 45°.

The second recess 56C is dimensioned so as to occupy a second arc defined by a second minor sector. The second minor sector is defined in part by a third sector notional line extending radially from the centre C of the notional circle and passing through a side edge of a third partial tooth 44, disposed adjacent to a first side of the second recess 56C, and in part by a fourth sector notional line extending radially from the centre C of the notional circle and passing through a side edge of a fourth partial tooth 44, disposed adjacent to a second, opposing, side of the second recess 56C. The third and fourth sector notional lines define an angle therebetween. The third angle may be in the range 35° to 50°, and may be around 45°.

The third recess 56A is dimensioned so as to occupy a third arc defined by a third minor sector. The third minor sector is defined in part by a fifth sector notional line extending radially from the centre C of the notional circle and passing through a side edge of a fifth partial tooth 44, disposed adjacent to a first side of the first recess 56A, and in part by a sixth sector notional line extending radially from the centre C of the notional circle and passing through a side edge of a sixth partial tooth 44, disposed adjacent to a second, opposing, side of the first recess 56A. The fifth and sixth sector notional lines define an angle therebetween. The third angle may be in the range 35° to 50°, and may be around 45°.

The first and fifth sector notional lines define a major or first toothed sector, the first toothed sector defines a fourth arc; the fourth arc is occupied by teeth 46, 44. That is to say teeth 46, 44 are disposed about the fourth arc, in a perimeter region of the second aperture A3.

The second and fourth sector notional lines define a third minor sector or second toothed sector, the second toothed sector defines a fifth arc; the fifth arc is occupied by teeth 46, 44. That is to say teeth 46, 44 are disposed about the fifth arc, in a perimeter region of the second aperture A3.

The third and sixth sector notional lines define a fourth minor sector or third toothed sector, the third toothed sector defines a sixth arc; the sixth arc is occupied by teeth 46, 44. That is to say teeth 46, 44 are disposed about the sixth arc, in a perimeter region of the second aperture A3.

The first and third recesses 56B, 56A are diametrically opposed to each other.

The second recess is oriented or disposed substantially orthogonally to the first and third recesses 56B, 56A.

The centre of the first and third recesses 56B, 56A of the second article retention structure RT2 are collinear with the centre of the first recess 56B of the first article retention structure RT1.

The third recess 56A of the second article retention structure RT2 is disposed proximate to the first recess 56B of the first article retention structure RT1 and is oriented in opposition thereto.

Each of the second recesses 56C of the second article retention structures RT2 is disposed proximate to a second recess of an adjacently disposed second article retention structures RT2, and is oriented in opposition thereto.

Each of the second recesses 56C of the first article retention structures RT1 is disposed proximate to a second recess of an adjacently disposed first article retention structures RT1, and is oriented in opposition thereto.

The grain of the material forming the blank 10 may be arranged to be tangential to the centre of the first and third recesses 56B, 56A of the second article retention structure RT2. The grain of the material forming the blank 10 may be arranged to be tangential to the centre of the first recess 56B of the first article retention structure RT1. In this way in order for a tear to propagate between the first aperture A1 and the second aperture A3 the tear must propagate across the grain of the blank 10. In this way the blank 10 is arranged to provide maximum resistance to tear propagation between the first and second apertures A1, A3.

Removal of the teeth 46, by providing recesses 56B, 56C, 56A at locations where two adjacent apertures A1, A2, A3, A4, A5, A6, A7, A8 are disposed in close proximity, has been found to reduce the likelihood of tear propagation, for example when packaging articles B2 of the sleek or slim design. This beneficial advantage may be a result of removal of the radial cut lines 48, 40 in regions of the blank 10 where the apertures A1, A2, A3, A4, A5, A6, A7, A8 are in closest proximity.

In one example the spacing d3, d4 between adjacent article retention structures RT1, RT2 may be around 0.186 inches (4.7 mm). The diameter d1 of notional circle or of the apertures A1, A2, A3, A4, A5, A6, A7, A8 may be around 1.771 inches (44.9 mm). The diameter d2 of the article receiving openings may be around 2.098 inches (53.2 mm). The teeth 146 may have a radial dimension or height (measured between the free or engaging edge E1 and the hinged connection to the main panel 114) of around 0.1625 inches (4.15 mm). The radial dimension of the teeth 146 is given by:

$$\tfrac{1}{2}(d2-d1).$$

The article receiving openings are disposed in close proximity to each other.

The diameter d2 of the article receiving openings is around eleven times greater than the spacing between them.

The spacing d3, d4 between article receiving openings may be less than half the diameter d2 of the article receiving openings. It may be less than a quarter, or fifth, of the diameter d2 of the article receiving openings. In some embodiments the spacing d3, d4 between article receiving openings may be less than an eighth, or tenth, of the diameter d2 of the article receiving openings.

The spacing d3, d4 between article receiving openings may less than twice the radial dimension or height of the teeth 46. In some embodiments the spacing d3, d4 between article receiving openings may less than 50% larger than the radial dimension or height of the teeth 46. In some embodiments the spacing d3, d4 between article receiving openings may less than 20% greater than the radial dimension or height of the teeth 46.

Figure 1A:
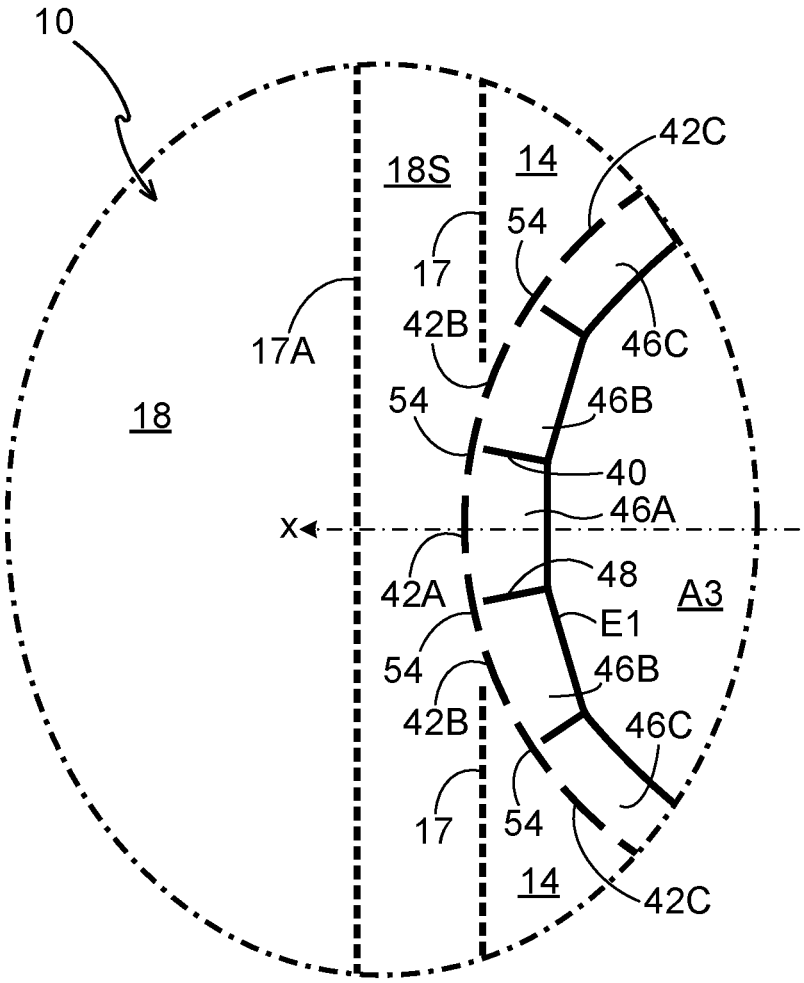
FIG. 1A is an enlarged plan view from above of a portion of the blank of FIG. 1.

FIG. 1A illustrates an enlarged view of a portion of the blank 10, it clearly illustrates that the article retention structures RT1, RT2 (a second article retention structure RT2 is shown) interrupt the fold lines 17, 19 between the main panel 14 and the shoulder panels 18S, 20S. In alternative embodiments, the article retention structures RT1, RT2 may interrupt a hinged connection between the main panel 14 and a side panel.

An outermost or first full tooth 46A is struck, in part, from the first shoulder panel 18S. The outermost tooth 46A is hingedly connected to the first shoulder panel 18S. The cut lines 42, 54 associated with the outermost tooth 46A are defined in the first shoulder panel 18S. Both of the pair of connecting nick or bridge portions hinging the first full tooth 46A to the blank 10 are disposed in the first shoulder panel 18S.

The first full tooth 46A lies upon the second notional line x-x.

Second full teeth 46B are disposed adjacent to, or adjoined by, the first full tooth 46A on opposing side thereof. The second full teeth 46B are struck, in part, from the first shoulder panel 18S. The second full teeth 46B are hingedly connected, in part, to the first shoulder panel 18S. The second full teeth 46B are hingedly connected, in part, to the main panel 14. One of a pair of the first circumferential cut lines 54 associated with each second full tooth 46B is defined in the first shoulder panel 18S. The other one of a pair of the first circumferential cut lines 54 associated with each second full tooth 46B is defined in the main panel 14. The second circumferential cut line 42 associated with each second full tooth 46B is defined in part in the first shoulder panel 18S and in part in the main panel 14. One of the pair of connecting nick or bridge portions hinging each second full tooth 46B to the blank 10 is disposed in the first shoulder panel 18S. The other one of the pair of connecting nick or bridge portions hinging each second full tooth 46B to the blank 10 is disposed in the main panel 14.

A third full tooth 46C is disposed adjacent to each second full tooth 46B. The third full teeth 46C are struck entirely from the main panel 14. The hinged connection between the third full teeth 46C, and the main panel 14 are entirely defined within the main panel 14.

Figure 1B:
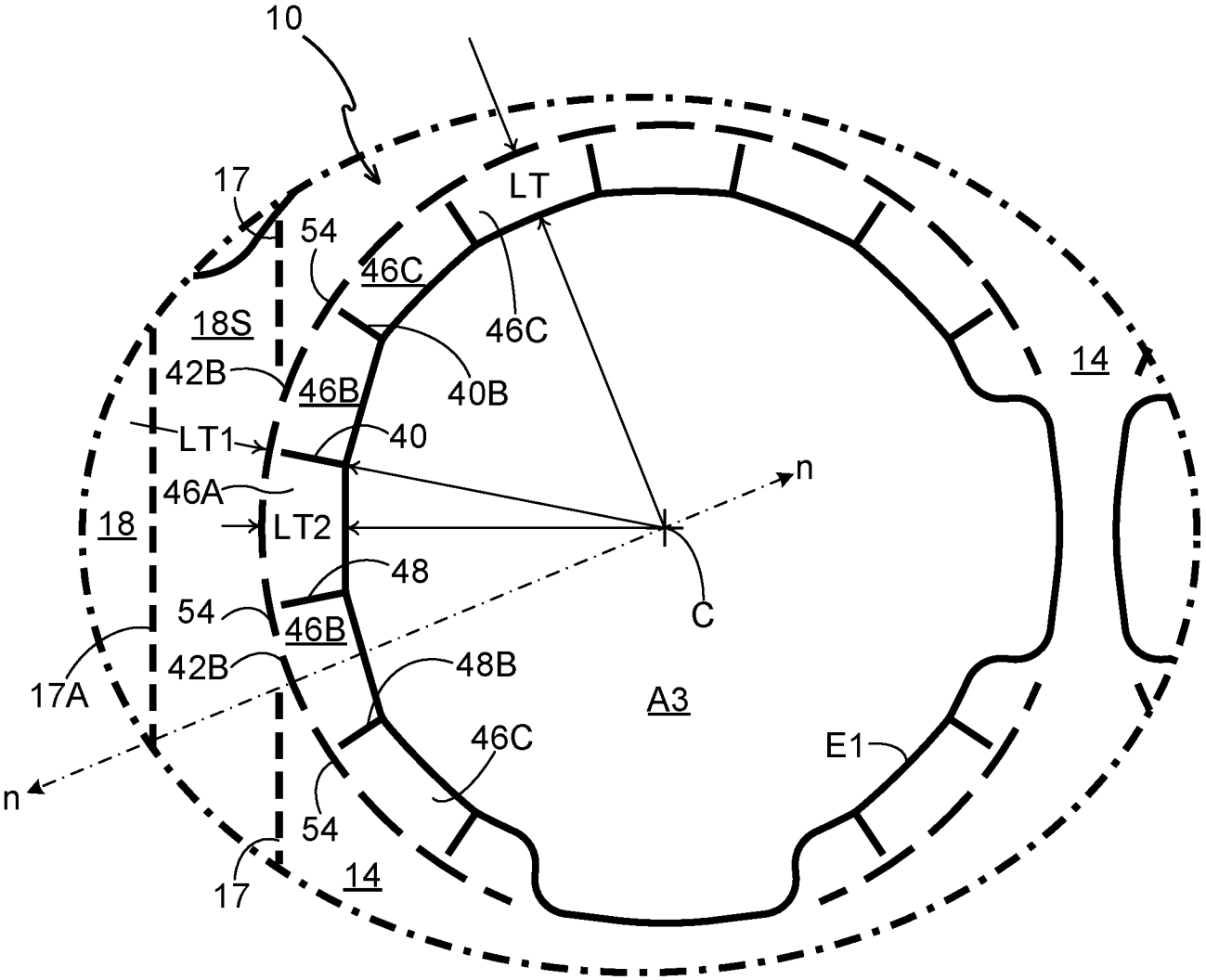
FIG. 1B illustrates an article retention structure according to embodiments of the present disclosure.

The first full tooth 46A comprises a first maximum radial dimension LT2, as shown in FIG. 1B; the first maximum radial dimension LT2 is defined at a mid-point of the first full tooth 46A. The third full teeth 46C comprises a third maximum radial dimension LT; the third maximum radial dimension LT is defined at a mid-point of the third full teeth 46C. The first maximum radial dimension LT2 is larger than the third maximum radial dimension LT. The first full tooth 46A is taller than either of the third full teeth 46C.

The second full teeth 46B each has a tapered shape. A first side edge of the second full teeth 46B has a second maximum radial dimension LT1; the second maximum radial dimension LT1 is defined at a side edge of the second full teeth 46B in abutment with the first full tooth 46A. The second maximum radial dimension LT1 of the second full teeth 46B is equal to the radial dimension of the first full tooth 46A at the point of abutment therewith. The second maximum radial dimension LT1 is less than the first maximum radial dimension LT2.

A second, opposing, side edge of the second full teeth 46B has a radial dimension equal to the radial dimension of a respective one of the third full teeth 46C at the point of abutment therewith. The second maximum radial dimension LT1 is greater than the third maximum radial dimension LT.

The second full teeth 46B each has a radial dimension which decreases gradually from the first side edge toward the second side edge such that each second full tooth 46B has a tapered shape wherein the free end edge of each second full tooth 46B is not perpendicular to a notional radial line n-n (FIG. 1B).

The cutline 40, 48 separating the first full tooth 46A from each of the second full teeth 46B is longer in length than a cutline 40B, 48B separating each second full tooth 46B from a respective one of the third full teeth 46C.

The blank 10 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulphate paperboard coated on one side, trade name Print-Kote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blank 10 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The present disclosure provides a carrier 90 of the top engaging type having article retention structures RT1, RT2 for engaging articles B, B1, B2.

The carrier 90 comprises a main panel 14, having one or more article retention structures RT1, RT2 for receiving and securing the main panel 14 to a respective article B1, B2. The carrier 90 comprises a pair of opposing side panels 18, 20 hingedly connected to the main panel 14. Each of the pair of opposing side panels 18, 20 may be hingedly connected to the main panel 14 by a shoulder panel 18S, 20S.

Advantageously, the shoulder panel 18S, 20S may improve the impact resistance of the carrier 90.

The carrier 90 comprises an end strap 26A/22A/12/22B/26B, 30A/24A/16/24B/30B hingedly connected between the pair of opposing side panels 18, 20 and free of direct connection to the main panel 14. The end strap 26A/22A/12/22B/26B, 30A/24A/16/24B/30B may be severably connected to the main panel 14 in blank form. A cutaway, in the form of a cutline, severable line, recess, slot or aperture, separates the end strap 26A/22A/12/22B/26B, 30A/24A/16/24B/30B; from the main panel 14.

Embodiments provide an article engaging carrier comprising a top panel 14 with at least one article-engaging feature RT1, RT2 and at least one shoulder panel 18S, 20S hingedly connected to the top panel 14 and disposed obliquely with respect thereto. The at least one engaging feature RT1, RT2 comprises an article-receiving aperture RT1, RT2 and an annular series of engaging tabs formed around the article-receiving aperture RT1, RT2. The annular series of engaging tabs comprises at least one first tab 46B and at least one second tab 46C. The at least one first tab 46B is hingedly connected in part to the top panel 14 and in part to the at least one shoulder panel 18S, 20S. The at least one first tab 46B has a first radial length LT1. The at least one second tab 48C is hingedly connected only to the top panel 14 and had a second radial length LT. The first radial length LT1 is greater than the second radial length LT.

Optionally, the at least one first tab 46B is hingedly connected by a first fold line 42 to the top panel 14 and to the at least one shoulder panel 18S, 20S. The first fold line 42 may extend from the top panel 14 into the at least one shoulder panel 18S, 20S.

Optionally, the at least one shoulder panel 18S, 20S is hinged to the top panel 14 by a shoulder panel fold line 17, 19 wherein the shoulder panel fold line 17, 19 is interrupted by the at least one first tab 46B.

Optionally, the at least one first tab 46B is asymmetrical about a radially extending notional line n-n, see FIG. 1B, passing through a midpoint of a first fold line 42 by which the at least one first tab 46B is hingedly connected to the top panel 14 and the at least one shoulder panel 18S, 20S.

Optionally, the at least one first tab 46B is adjoined by a third tab 46A which is hingedly connected only to the at least one shoulder panel 18S, 20S Optionally, the third tab 46A has a third radial length LT2 which is greater than the second radial length LT.

Optionally, the third tab 46A is formed in part from the at least one shoulder panel 18S, 20S.

Optionally, the at least one first tab 46B comprises a pair of first tabs 46B which are disposed with the third tab 46A therebetween.

A fugitive glue may be employed to secure the side panels 18, 20 to the articles B, B1, B2. An example of a specific glue is Swift®melt 7044 manufactured by HB Fuller. Use of a fugitive glue is optional, an advantage of a fugitive glue is its tendency to remain attached to the carrier 90 when the articles B, B1, B2 are disengaged from the carrier 90 (this may be more desirable than having the glue remain attached to the articles B, B1, B2). In alternative embodiments other adhesives maybe employed such as, but not limited to, hot-melt glue.

It can be appreciated that various changes may be made within the scope of the present invention. For example, the size and shape of the panels and apertures may be adjusted to accommodate articles of differing size or shape. The shoulder panels may be omitted. The present invention is not limited to cartons of the top-engaging type, the invention may be employed with other carton styles such as, but not limited to, open top crates, lidded or closed top crates.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article engaging carrier for packaging at least one article, the carrier comprising a top panel with at least one article-engaging feature and at least one shoulder panel hingedly connected to the top panel and disposed obliquely with respect to the top panel, the at least one article-engaging feature comprising an article-receiving aperture and an annular series of engaging tabs formed around the article-receiving aperture, the annular series of engaging tabs comprising at least one first tab and at least one second tab, the at least one first tab being hingedly connected in part to the top panel and in part to the at least one shoulder panel, the at least one first tab having a first radial length, the at least one second tab being hingedly connected only to the top panel and having a second radial length, wherein the first radial length is greater than the second radial length.

2. An article carrier according to claim 1, wherein the at least one first tab is hingedly connected by a first fold line to the top panel and to the at least one shoulder panel, the first fold line extends from the top panel into the at least one shoulder panel.

3. An article carrier according to claim 1, wherein the at least one shoulder panel is hinged to the top panel by a shoulder panel fold line wherein the shoulder panel fold line is interrupted by the at least one first tab.

4. An article carrier according to claim 1, wherein the at least one first tab is asymmetrical about a radially extending notional line passing through a midpoint of a first fold line by which the at least one first tab is hingedly connected to the top panel and to the at least one shoulder panel.

5. An article carrier according to claim 1, wherein the annular series of engaging tabs further comprises at least one third tab and wherein the at least one first tab is adjoined by the at least one third tab which is hingedly connected only to the at least one shoulder panel.

6. An article carrier according to claim 5, wherein the at least one third tab has a third radial length which is greater than the second radial length.

7. An article carrier according to claim 5, wherein the at least one third tab is formed in part from the at least one shoulder panel.

8. An article carrier according to claim 5, wherein the at least one first tab comprises a pair of first tabs which are disposed with the at least one third tab therebetween.

9. A blank for forming an article carrier, the blank comprising a top panel with at least one article-engaging feature and at least one shoulder panel hingedly connected to the top panel and disposed obliquely with respect to the top panel when the blank is erected to form an article carrier, the at least one article-engaging feature comprising an article-receiving aperture and an annular series of engaging tabs formed around the article-receiving aperture, the annular series of engaging tabs comprising at least one first tab and at least one second tab, the at least one first tab being hingedly connected in part to the top panel and in part to the at least one shoulder panel, the at least one first tab having a first radial length, the at least one second tab being hingedly connected only to the top panel and having a second radial length, wherein the first radial length is greater than the second radial length.

10. A blank according to claim 9, wherein the at least one first tab has a maximum radial length and a minimum radial length and wherein the first radial length is the maximum radial length.

11. A blank according to claim 10, wherein the minimum radial length of the at least one first tab is generally equal to the second radial length of the at least one second tab.

12. A blank according to claim 10, wherein the at least one first tab has an opposed side edges and wherein the at least one first tab has the maximum radial length along one of the opposed side edges.

13. A blank according to claim 12, wherein the at least one first tab has the minimum radial length along the other of the opposed side edges.

14. A blank according to claim 13, wherein the at least one first tab has a radial size which decreases gradually from one of the opposed side edges toward the other of the opposed side edges.

15. A blank according to claim 10, wherein the at least one first tab has an opposed side edges and wherein the at least one first tab has the minimum radial length along one of the opposed side edges.

16. A blank according to claim 15, wherein the one of the opposed side edges of the at least one first tab is adjoined by the at least one second tab.

17. A blank according to claim 9, wherein the annular series of engaging tabs further comprises at least one third tab and wherein the at least one first tab is adjoined by the at least one third tab which is hingedly connected only to the at least one shoulder panel.

18. A blank according to claim 17, wherein the at least one third tab has a third radial length which is greater than the second radial length.

19. A blank according to claim 17, wherein the at least one third tab is formed in part from the at least one shoulder panel.

20. A blank according to claim 17, wherein the at least one first tab comprises a pair of first tabs which are disposed with the at least one third tab therebetween.

* * * * *